US006432072B1

(12) United States Patent
Harris et al.

(10) Patent No.: US 6,432,072 B1
(45) Date of Patent: Aug. 13, 2002

(54) HAND HELD PERCUSSIVE MASSAGER WITH ADJUSTABLE NODES

(75) Inventors: David Harris; Rudy Woodard, both of Nashua, NH (US)

(73) Assignee: Brookstone Company, Inc., Nashua, NH (US)

( * ) Notice: Subject to any disclaimer, the term of this patent is extended or adjusted under 35 U.S.C. 154(b) by 0 days.

(21) Appl. No.: 09/489,049

(22) Filed: Jan. 21, 2000

(51) Int. Cl.[7] ..... A61H 23/02

(52) U.S. Cl. ..... 601/108; 601/111; 601/101; 601/103; 601/70

(58) Field of Search ..... 601/134, 135, 601/97, 101, 103, 107, 108, 110, 111, 112, 113, 70, 72

(56) References Cited

U.S. PATENT DOCUMENTS

| | | | | |
|---|---|---|---|---|
| 2,781,040 | A | 2/1957 | Hill | 128/33 |
| 2,964,037 | A | 12/1960 | Johnston | 128/49 |
| 3,830,232 | A | 8/1974 | McNair | 128/33 |
| 4,458,676 | A | 7/1984 | Pileggi | 128/53 |
| 4,590,926 | A | 5/1986 | Courtin | 128/67 |
| 5,063,911 | A | 11/1991 | Teranishi | 128/32 |
| 5,088,474 | A | 2/1992 | Mabuchi et al. | 128/52 |
| 5,099,826 | A | 3/1992 | Hayakawa | 128/36 |
| 5,159,992 | A | 11/1992 | Mabuchi et al. | 128/52 |
| 5,183,034 | A | 2/1993 | Yamasaki et al. | 128/36 |
| 5,305,738 | A | 4/1994 | Shimizu | 601/35 |
| 5,785,668 | A | 7/1998 | Shimizu | 601/50 |
| 5,827,205 | A | 10/1998 | Iwamoto | 601/78 |
| 5,925,002 | A | 7/1999 | Wollman | 601/70 |

OTHER PUBLICATIONS

Company Catalog, "Brookstone Gift Collection", Holiday 1997, p. 30.

Company Catalog, "Brookstone Gift Collection", Holiday Gifts 1998, p. 11.

Company Catalog, "Brookstone GIft Collection", Holiday Gifts 1998, pp. 6 & 7.

*Primary Examiner*—Michael A. Brown
*Assistant Examiner*—Benjamin K. Koo
(74) *Attorney, Agent, or Firm*—Hayes Soloway P.C.

(57) ABSTRACT

A hand-held massager having a flat vibrating massage head and a pair of percussion massage nodes all being driven by a single internal drive unit. The percussion massage nodes are adjustable for width adjustments being manually controlled by the flat massage head on the opposite side of the massage head. Separate push button controls covered by a sealing membrane are carried on the body of the unit to control power, speed and type of massage.

22 Claims, 4 Drawing Sheets

HAND HELD PERCUSSIVE MASSAGER WITH ADJUSTABLE NODES

FIELD OF THE INVENTION

The present invention relates to a personal hand-held massaging device and more particularly to a hand-held combination vibratory/percussive massager having a pair of adjustable width percussion massage nodes, the adjustment for width thereof being controlled by an opposing flat vibratory massage head, and independent controls for setting the levels of the vibration of the massaging elements.

BACKGROUND OF THE INVENTION

Hand-held vibrating massagers are well known in the art. Such massagers include a handle attached to a vibratory massaging head and driven by an electric motor with limited adjustment for intensity of the vibration. Also known in the art are hand-held percussive massagers, typically having a pair of percussion massage nodes. The heads or nodes of these conventional massagers are in a fixed location in the massager. Thus, while providing a vibratory sensation they are limited in ability to adjust to the various contours of a person's anatomy, for example, the neck, shoulders, arms and legs, thereby limiting the point of contact of the massage to a pre-set spacing. Moreover, conventional hand-held massagers typically provide either vibratory or percussive massage, but not both. Thus, the consumer is forced to purchase two devices in order to enjoy both types of massage.

SUMMARY OF THE INVENTION

It is therefore an object of the present invention to provide a hand-held massager having both vibratory and percussive massage capabilities and including a vibratory massage head, and a pair of percussive massage nodes suitable to deliver an effective therapeutic massage to the various contours of the body. In a preferred embodiment of the invention, the percussive massage nodes are adjustable in width using an adjustment mechanism, which can be manually or automatically engaged. In another and preferred embodiment, the massager includes an elongated contoured handle, a control panel including an on-off switch and power setting switch, a first massaging element comprising a generally flat rounded massage head for localized vibrational massage, and a second massaging element comprising a pair of percussion massage nodes, which are adjustable width-wise. Preferably, the percussion massage nodes are semi-spherical in shape, and width adjustment between the percussion massage nodes is made by turning the opposing flat massage head which is connected to a shaft driving a rack and pinion mechanism connected to a screw drive, or worm and roller type device, which causes the nodes to move laterally in relation to each other.

The source of vibration and percussion is provided through unbalanced eccentric cams attached to the shaft of a single rotary electric motor carried in the massager. In operation the drive shaft rotates the unbalanced eccentric cams on both sides thereby providing reciprocating percussion movement to the percussive massage nodes. In an alternate embodiment, the cams corresponding to each of the massage nodes are also adjustable so that the positions of the cams may be in phase, causing the massage nodes to move simultaneously, out of phase, causing the massage nodes to move reciprocally, or any setting thereinbetween to vary the vibratory effect. The reciprocating percussion movement of the eccentric cams also causes a generalized vibration of the single massage head. In yet another embodiment of the invention, two separate motors, which may be rotational or linear, e.g. solenoids, may be employed for creating in-phase/out-of-phase vibrating action.

In a particularly preferred embodiment, independent controls for setting the speed of the motor, the levels of the vibration of the vibratory and percussive massaging elements and for power, preferably in the form of touch sensitive buttons maintained beneath a thin rubber-like membrane, are mounted on the handle of the massager. The thin membrane covers the individual buttons thereby preventing introduction of powders, fluids, oils or the like, into the switches while allowing independent setting of the controls.

BRIEF DESCRIPTION OF THE DRAWINGS

These and other objects, features and advantages of the present invention will be better understood with reference to the detailed description of the preferred embodiment and the accompanying drawings, wherein numerals depict like parts, and wherein.

BRIEF DESCRIPTION OF THE DRAWINGS

Figure 1:
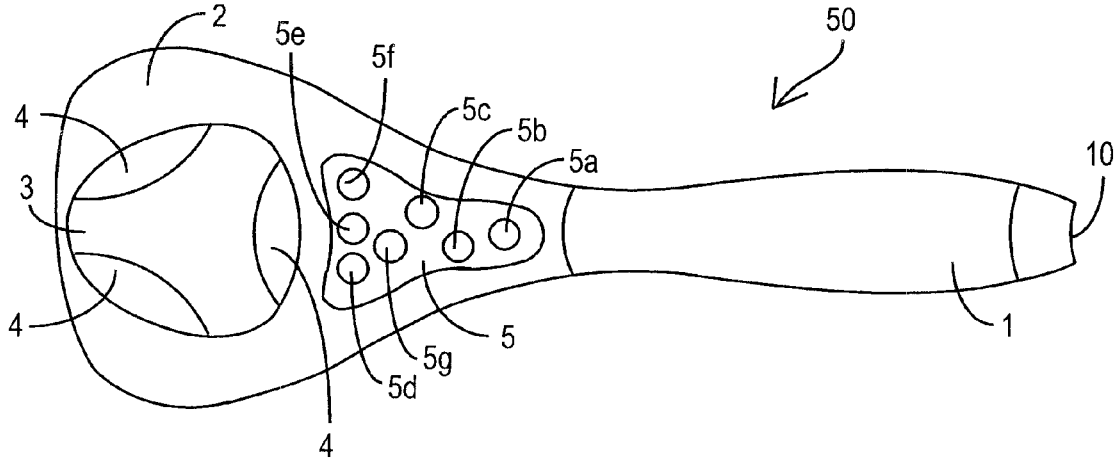
FIG. 1 is a top plan view of the hand-held massager in accordance with the present invention.
Figure 2:
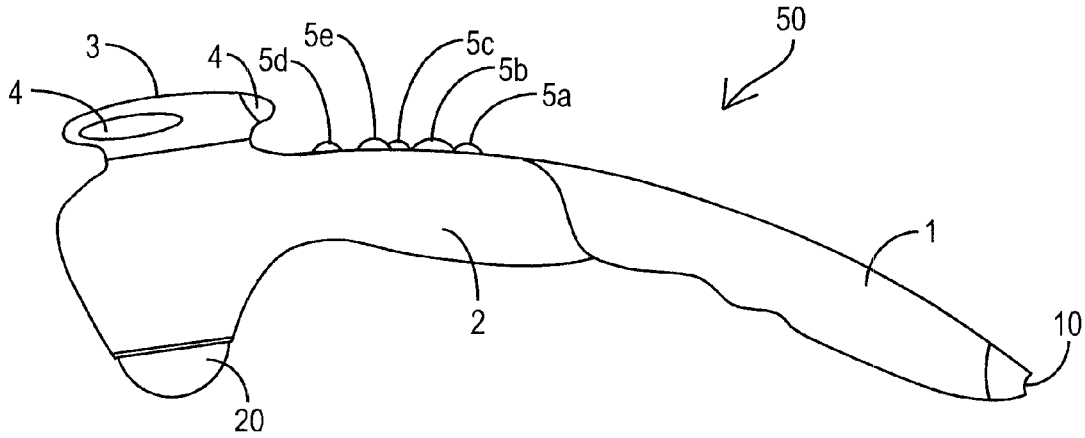
FIG. 2 is a side plan view of the hand-held massager shown in FIG. 1.
Figure 6:
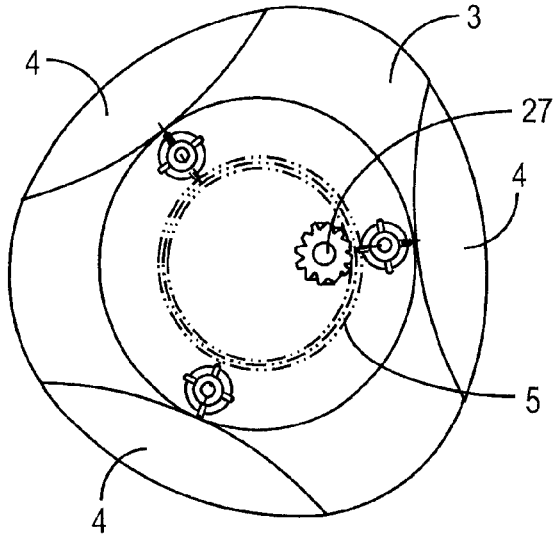
FIG. 6 is a top plan view of the flat head massager and width adjustment control according to the present invention.

Referring to FIGS. 1 and 2, a hand-held massager 50 comprises an elongated handle 1 contoured so as to be comfortable grasped in the hand of the user. The handle 1 is connected to the massager body 2 which includes control panel 5, a first vibratory massaging element comprising a generally flat rounded massage head 3, and a second percussive massaging element comprising two substantially semi-spherical shaped adjustable massage nodes 20. The control panel 5 preferably comprises a capacitive switch having an elastomeric membrane activator, sealed to the handle, and covering a plurality of touch sensitive control buttons or switches, including power control button 5*a*, speed setting control button 5*b*, LED speed indicator 5*c*, and various massage program buttons 5*d–g* for setting massage sensation, intensity and frequency of the vibrations of the percussive massage nodes 20 and vibratory massage head 3. As shown in FIG. 6, vibratory massage head 3 is generally rounded in shape with a gently curved upper surface with resilient insert elements 4, such as of rubber, attached or mounted thereon, for delivering direct localized vibratory massage. Vibratory massage head 3 preferably also serves as a manual adjustment mechanism for adjusting the width of generally semi-spherical percussive massage nodes 20. As will be discussed below, width adjustment between the percussive massage nodes 20 preferably is made by vibratory turning massage head 3 which is connected to a shaft driving a rack and pinion mechanism connected to screw drive, or worm and roller type device, in either direction which causes percussive massage nodes 20 to move laterally in relation to each other. Alternatively, the width adjustment mechanism may be power driven, for example, by connection to the motor, and controlled by a switch provided on the control panel 5.

Percussive massage nodes 20 are generally semi-spherical in shape and have an outer surface 15 of resilient material such as rubber or other suitable cushioning material covering massage head 17 which is made of a harder plastic or the like. The percussive massage nodes 20 are adjustable width-wise in relation to each other in order to accommodate the various contours of the body to deliver an effective safe therapeutic massage. That is to say, the node width adjustment allows the nodes to be placed at the appropriate spacing to avoid damaging or bruising the vertebrae. Power to the massager is provided by electricity through AC cord plug connection at the end 10 of the massager or by rechargeable battery housed within the massager and chargeable through a connection (not shown) mounted on the massager.

Figure 3:
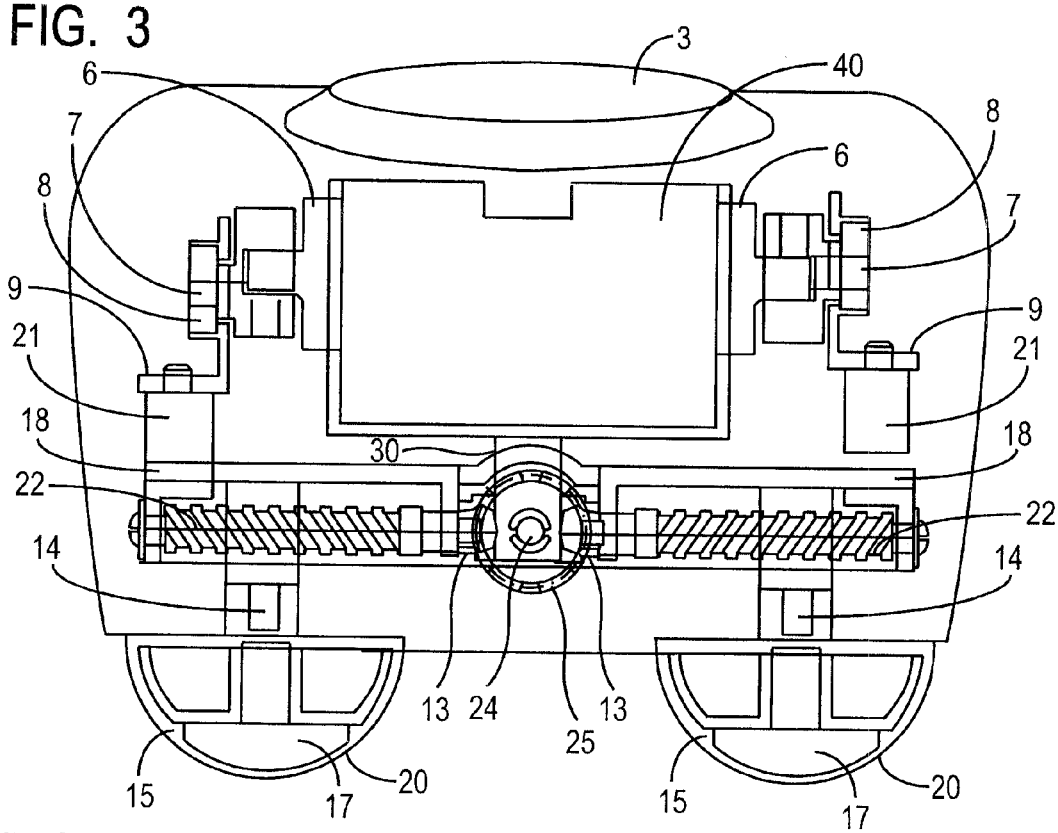
FIG. 3 is a cross-sectional diagrammatic view of the front of the hand-held massager.

Referring now to FIG. 3, electric rotary motor 40 is connected to rotating drives 6 on either side connected to rotary drive arms 7 eccentrically installed to cylindrical cams 8, disposed in such a manner that as motor 40 turns, the rotation of rotary drives 6 causes cylindrical cams 8 to rotate around rotary drive arms 7 and reciprocally lift and push down pivot arms 9 attached to spacers 21. The downward stroke of spacers 21 strikes respective housings 18 interposed above percussive massage node mounts 14 to respective percussive massage nodes 20, thereby resulting in percussive driving of the massage nodes 20. Preferably, a screw drive 22 is mounted in respective housing 18 for adjusting the width of the percussive nodes 20 as will be described below. As power to the motor 40 increases, the rotational speed of cylindrical eccentric cams 8 driven by rotary drives 6 and rotary drive arms 7 increases, increasing the speed of the stroke cycle of spacers 21 striking surfaces 18, resulting in greater intensity of the percussion of massage nodes 20. The stroke cycle of spacers 21 may be adjusted by rotating respective rotary drives 6 and rotary drive arms 7 to be more or less in phase so that the downward strokes of spacers 21 occur in unison, or out of phase so that the downward strokes of respective spacers 21 are opposing, or any other setting in between. This adjustment may be performed automatically by one of the massage program buttons on control panel 5. In order to accommodate adjustments in phase of the downward stroke, screw drives 22, housings 18 and massage nodes 20, on each side of flat gear 25 and shaft 24 are independently suspended therefrom in the manner of half-shafts. In an alternative embodiment, massager 50 is not phase-adjustable thereby permitting screw drives 22, housings 18 and massage nodes 20 to be mounted on a single axle-like fashion on each side of flat gear 25 and shaft 24.

Figure 4:
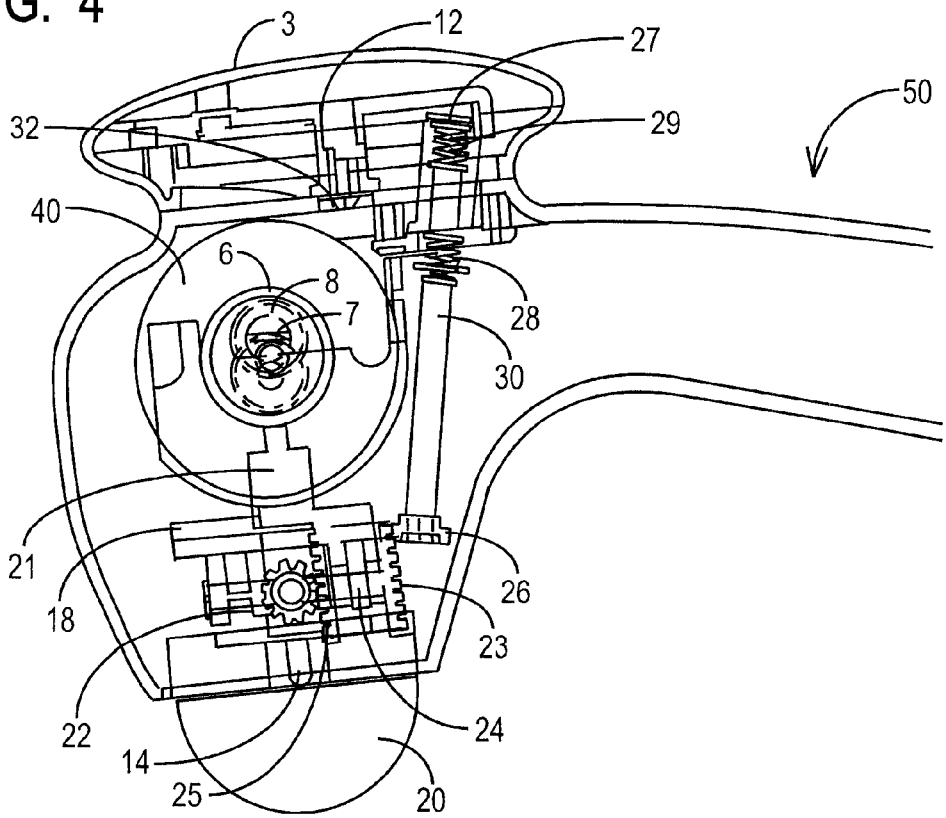
FIG. 4 is a cross-sectional side elevational view of the hand-held massager shown in FIG. 3.
Figure 5:
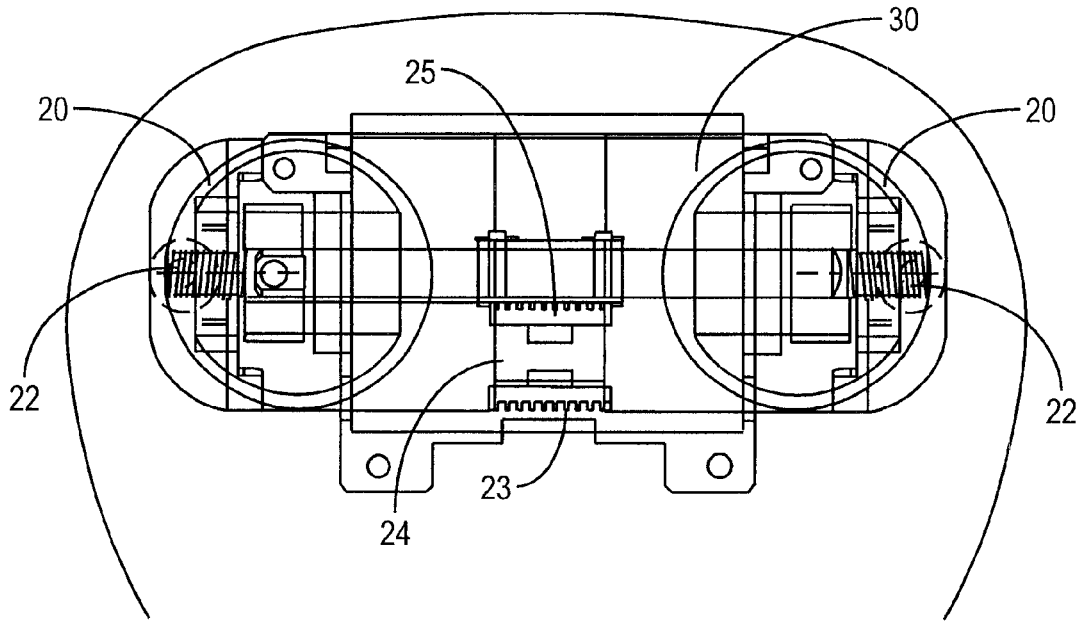
FIG. 5 is a cross-sectional top view of the hand-held massager shown in FIG. 4.

Percussion massage nodes 20 are adjustable width-wise in relation to each other by a rack and pinion-type mechanism controlled by massage head 3 connected thereto by a shaft 30. In use massage head 3, is turned in a clock-wise or counter-clockwise direction engaging flat gear 27 attached to the top of shaft 30 as shown in FIG. 6. Referring to FIGS. 3–5, as shaft 30 is rotated, flat gear 26 attached at the lower end of shaft 30 also rotates, engaging gear flat 23 attached to shaft 24 at the one end and to flat gear 25 at the other, causing flat gear 25 to turn, engaging flat gears 13 engaging screw drives 22 which also turn. As screw drives 22 turn, percussive massage node mounts 14 which are internally threaded are caused to move laterally in opposite directions along the shafts of screw drives 22, thereby resulting in the desired width adjustment of percussive massage nodes.

As shown in FIG. 4, flat massage head 3 is rotatably connected to massager body 2 by screw 32 and fitting 12. Flat gear 27 is situated on the underside of flat massage head 3 and meshes with gearing 5 of flat massage head 3 so that as massage head 3 is rotated flat gear 27 and shaft 30 to which it is attached, also turn. As described above, the rotation of massage head 3 causes a change in spacing between the percussive massage nodes. By virtue of its direct connection to the percussive massage node width adjustment mechanism by shaft 30, in operation the same electric motor 40 which drives the percussive massage nodes 20 also transmits a generalized vibration to flat massage head 30. Springs 28 and 29 on shaft 30 serve to dampen the vibration so transmitted and enhance the effect of the vibratory massage provided by head 30.

Through adjustment of the width of the generally semi-spherical massage nodes, the hand-held massager is capable of adjusting to and making contact with the contours of the body thereby providing maximum therapeutic massage effect to various body parts previously unreached by conventional massagers.

This will provide the user with a greater range of therapy and will accordingly be of greater benefit. In addition, with the ability to independently manipulate the speed, intensity and the pattern of the vibratory massage, the user may create a multitude of sensations to attain the desired result. Further, the thin tactile membrane covering the full control panel will keep massage oils, powder, fluids, or the like from gumming up the buttons or otherwise entering the massage unit itself. This will make cleaning easier and provide longer operational life.

Figure 7A:
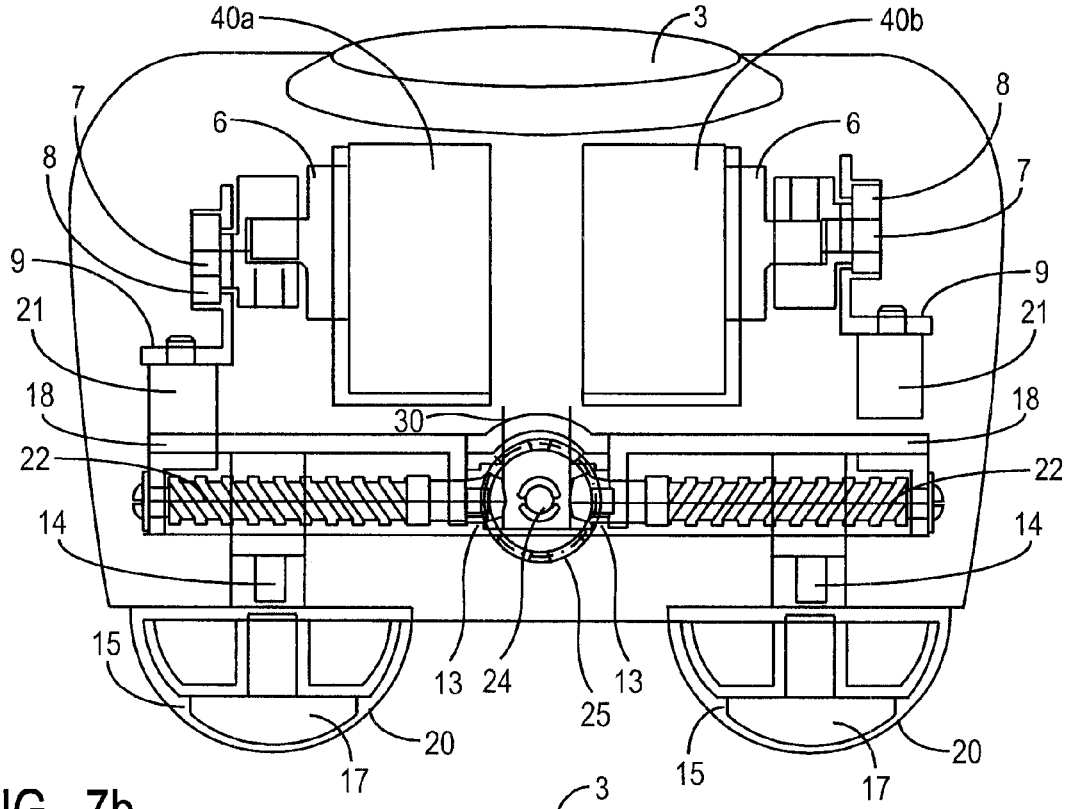
FIGS. 7*a* and 7*b* are views similar to FIG. 3, and showing two alternative embodiments of the hand-held massager of the present invention.
Figure 7B:
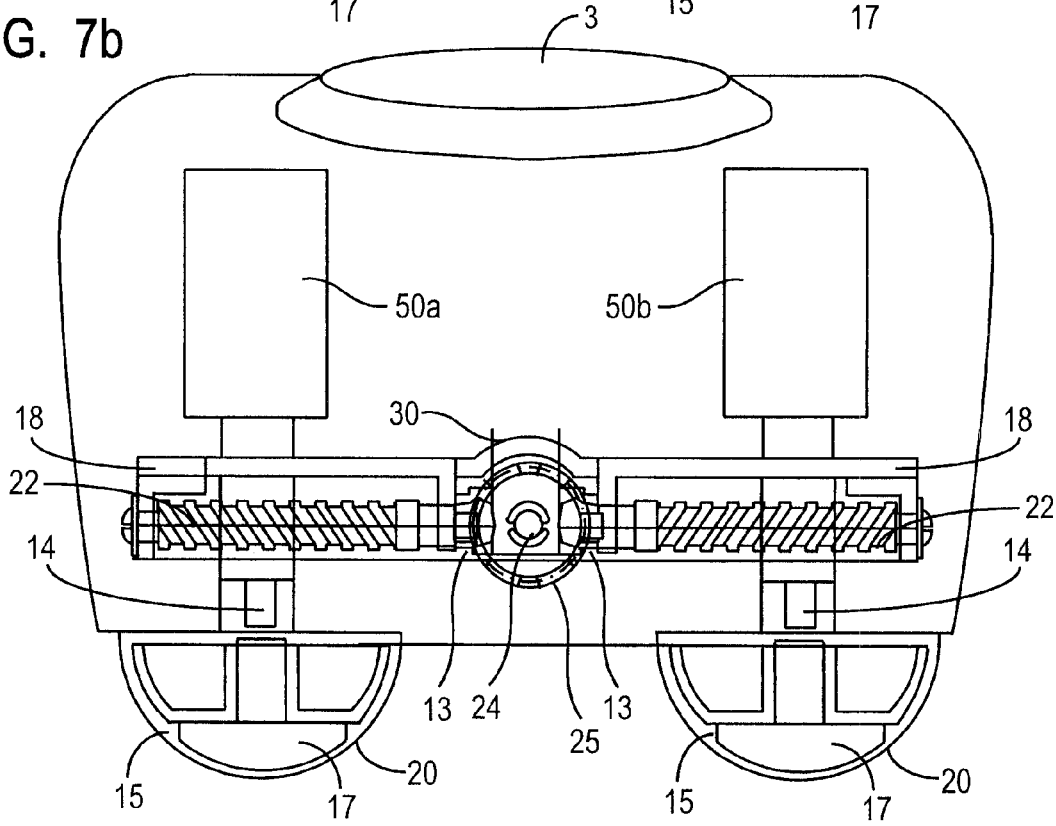

Various changes may be made without departing from the spirit and scope of the invention. For example, percussive nodes 20 which preferably are threaded on shafts 14 may be made replaceable with different size/shape nodes. Also, a heating and/or cooling element may be incorporated into vibratory massage head 3 for warming the vibratory massage head and/or in percussive massage mounts 14 for warming the percussive massage nodes 20. Further, as shown in FIG. 7*a* two separate rotational motors 40*a*, 40*b* which may be selectively driven in-phase or out-of-phase be employed in place of the single motor 40. Or, as shown in FIG. 7*b*, a pair of linear motors, i.e. solenoids 50*a*, 50*b* may be employed, fixed directly to node mounts 14.

Although described in terms of the presently preferred embodiment, those skilled in the art will appreciate that the present invention is not limited to the embodiment described.

What is claimed is:

1. A hand-held massager comprising:

an elongated handle connected to the massager body having a control means;

a first vibratory massaging element mounted to one side of said massager body, and a pair of percussive massage nodes mounted to the side opposite; and a motor drive for powering both said vibratory massaging element and said percussive massager nodes;

wherein the percussive massage nodes are adjustable in width by rotation of said vibratory massaging element; and wherein the vibratory massaging element is rotatably mounted on a shaft, said shaft driving a rack and pinion connected to a screw drive for causing changes in the width of the percussive massage nodes mounts attached to the massage nodes..

2. The hand-held massager of claim 1, wherein the motor drive comprises a single electric rotary motor having a rotating shaft extending from either side of said motor, said rotating shaft being connected to rotary drive arms eccentrically carried on a pair of canes, each said cam being connected to a reciprocal pivot arm attached to said percussive massage nodes, as wherein rotation of said motor causes rotation of the said rotary drive arms which in turn cause said cams to move said pivot arms whereby to induce percussive movement of said massage nodes.

3. The hand-held massager of claim 2, wherein the motor drive is powered by a rechargeable battery housed within the massager.

4. The hand-held massager of claim 1, wherein the vibratory massaging element is generally rounded in shape with a generally flat upper surface and having resilient insert elements.

5. The hand-held massager of claim 1, wherein said percussive massage node mounts are internally threaded to move laterally in opposite directions along the shafts of the said screw drives.

6. The hand-held massager of claim 1, wherein the percussive massage nodes are removably mounted on said mounts.

7. The hand-held massager of claim 1, wherein the percussive massage nodes comprise semi-spherical shaped elements.

8. The hand-held massager of claim 1, and including a control panel having an elastomeric membrane sealed to the handle and covering a plurality of touch sensitive control buttons or switches.

9. The hand-held massager of claim 8, wherein the control panel includes a power control button, a speed setting control button, and LED speed indicator, and a plurality of the massage program buttons for setting massage sensation and intensity of the vibrations of the massage elements.

10. The hand-held massager of claim 9, wherein the width adjustment mechanism is powered and is controlled by a switch on the control means.

11. The hand-held massager of claim 1, wherein phase of movement of the percussive massage nodes is adjustable.

12. The hand-held massager of claim 1, wherein the percussive massage node mounts are independently suspended from the width adjustment and connected to the motor by shafts.

13. The hand-held massager of claim 1, wherein the vibratory massaging element is connected to the massage node width adjustment mechanism by a shaft which transmits a generalized vibration to the vibratory massage element coincident with movement of the percussive massaging nodes.

14. The hand-held massager of claim 13, and further including springs operatively disposed on said shaft to dampen vibration.

15. The hand-held massager of claim 1, wherein the motor drive comprises a pair of electric rotary motors, each having a rotating shaft extending therefrom, each said rotating shaft being connected to a rotary drive arm eccentrically carried on a cam, each said cam being connected to a reciprocal pivot arm attached to said percussive massage nodes, wherein rotation of said motor causes rotation of its respective rotary drive arm which in turn causes a respective cam to move its respective pivot arm whereby to induce percussive movement of its respective massage node.

16. The hand-held massager of claim 1, wherein the motor drive comprises a pair of linear motors.

17. The hand-held massager of claim 1, wherein the vibratory massaging element is rotatably mounted on a shaft, said shaft driving a rack and pinion connected to a screw drive, which causes changes in the width of the percussive massage node mounts attached to the massage nodes.

18. The hand-held massager of claim 17, wherein said percussive massage node mounts are internally threaded to move laterally in opposite directions along the shafts of the said screw drives.

19. The hand-held massager of claim 17, wherein the percussive massage nodes are removably mounted on said mounts.

20. The hand-held massager of claim 6, wherein the percussive massage node mounts are independently suspended from the width adjustment and connected to the motor by shafts.

21. The hand-held massager of claim 6, wherein the vibratory massaging element is connected to the massage node width adjustment mechanism by a shaft which transmits a generalized vibration to the vibratory massage element coincident with movement of the percussive massaging nodes.

22. The hand-held massager of claim 21, and further including springs operatively disposed on said shaft to dampen vibration.

* * * * *

UNITED STATES PATENT AND TRADEMARK OFFICE

CERTIFICATE OF CORRECTION

PATENT NO. : 6,432,072 B1
DATED : August 13, 2002
INVENTOR(S) : Harris et al.

It is certified that error appears in the above-identified patent and that said Letters Patent is hereby corrected as shown below:

Column 5,
Line 8, “canes” should be -- cams --.

Signed and Sealed this

Twenty-eighth Day of December, 2004

JON W. DUDAS
*Director of the United States Patent and Trademark Office*